US012213631B1

(12) United States Patent
Honer

(10) Patent No.: US 12,213,631 B1
(45) Date of Patent: Feb. 4, 2025

(54) SOAP GRINDER AND DISPENSER

(71) Applicant: Kim Honer, Hialeah, FL (US)

(72) Inventor: Kim Honer, Hialeah, FL (US)

( * ) Notice: Subject to any disclaimer, the term of this patent is extended or adjusted under 35 U.S.C. 154(b) by 226 days.

(21) Appl. No.: 17/867,844

(22) Filed: Jul. 19, 2022

(51) Int. Cl.
*A47K 5/09* (2006.01)
*A47K 5/12* (2006.01)

(52) U.S. Cl.
CPC ..... *A47K 5/09* (2013.01); *A47K 5/1217* (2013.01)

(58) Field of Classification Search
CPC ..... Y10S 241/602; A47K 5/09
USPC ..... 241/602
See application file for complete search history.

(56) References Cited

U.S. PATENT DOCUMENTS 2,282,866 A 5/1942 Hagen
3,119,779 A * 1/1964 Barrows ..... C11D 13/00 261/DIG. 26
5,022,591 A * 6/1991 Sanders ..... A47J 42/10 241/258
5,286,106 A 2/1994 Burgos
5,368,387 A 11/1994 Creighton
5,511,882 A 4/1996 Anwuhah
5,636,922 A 6/1997 Clark
8,136,699 B2 3/2012 Bianchini
D701,075 S 3/2014 Wai
11,490,769 B1 * 11/2022 Bindler ..... A47K 5/09
2016/0374503 A1 * 12/2016 Yoshidome ..... A47J 42/38 99/286
2022/0251481 A1 * 8/2022 Burks, Jr. ..... C11D 9/265

FOREIGN PATENT DOCUMENTS

KR 20110009328 A * 8/2011

* cited by examiner

*Primary Examiner* — Jared O Brown
(74) *Attorney, Agent, or Firm* — Kyle A. Fletcher, Esq.

(57) ABSTRACT

The soap grinder and dispenser is configured for use with a soap. The soap grinder and dispenser grinds the plurality of soap chips into a bulk solid phase. The soap grinder and dispenser dispenses the plurality of soap chips in a phase selected from the group consisting of: a) a liquid phase; and, b) a bulk solid phase. The soap grinder and dispenser comprises a containment structure, a burr grinder, an electric motor, and a heating element. The burr grinder, the electric motor, and the heating element mount in the containment structure.

14 Claims, 4 Drawing Sheets

SOAP GRINDER AND DISPENSER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of dispensers for soap for liquid or pasty soap. (A47K5/12)

SUMMARY OF INVENTION

The soap grinder and dispenser is configured for use with a soap. The soap grinder and dispenser grinds the plurality of soap chips into a bulk solid phase. The containment structure stores the plurality of soap chips as a bulk solid. The soap grinder and dispenser dispenses the plurality of soap chips in a phase selected from the group consisting of: a) a liquid phase; and, b) a bulk solid phase. The soap grinder and dispenser comprises a containment structure, a burr grinder, an electric motor, and a heating element. The burr grinder, the electric motor, and the heating element mount in the containment structure These together with additional objects, features and advantages of the soap grinder and dispenser will be readily apparent to those of ordinary skill in the art upon reading the following detailed description of the presently preferred, but nonetheless illustrative, embodiments when taken in conjunction with the accompanying drawings.

In this respect, before explaining the current embodiments of the soap grinder and dispenser in detail, it is to be understood that the soap grinder and dispenser is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the soap grinder and dispenser.

It is therefore important that the claims be regarded as including such equivalent construction insofar as they do not depart from the spirit and scope of the soap grinder and dispenser. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
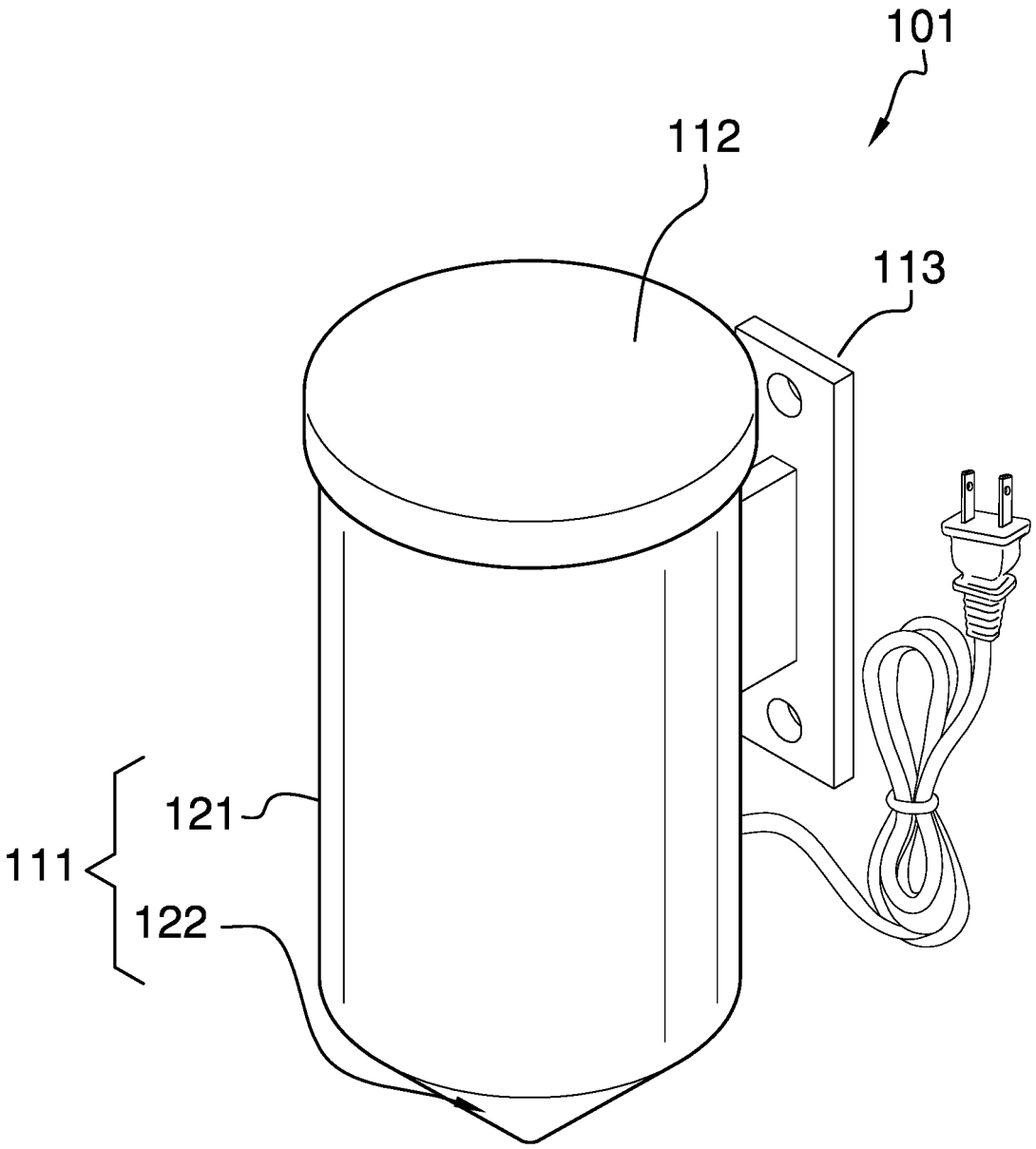
FIG. 1 is a perspective view of an embodiment of the disclosure.
Figure 2:
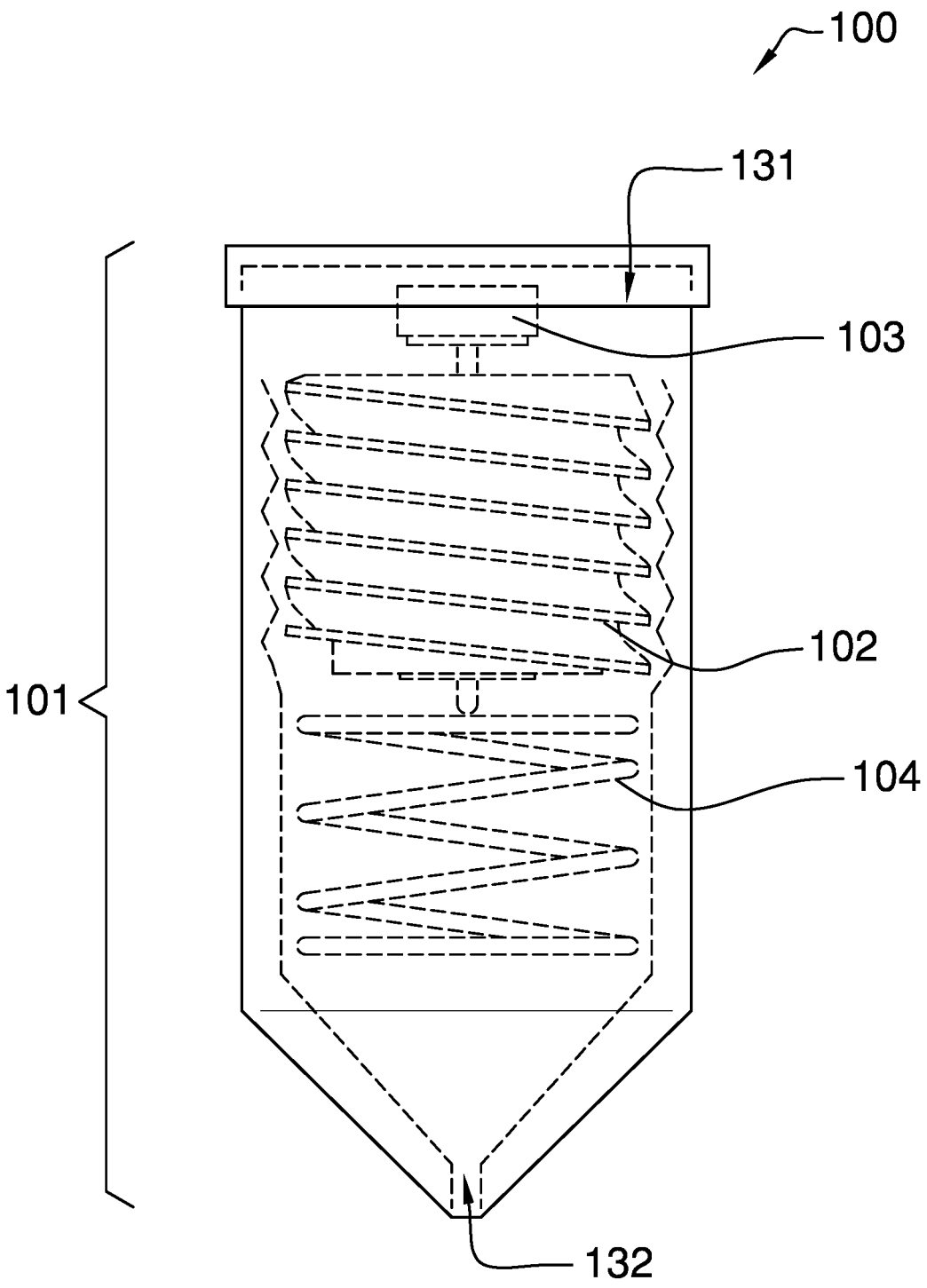
FIG. 2 is a front view of an embodiment of the disclosure.
Figure 3:
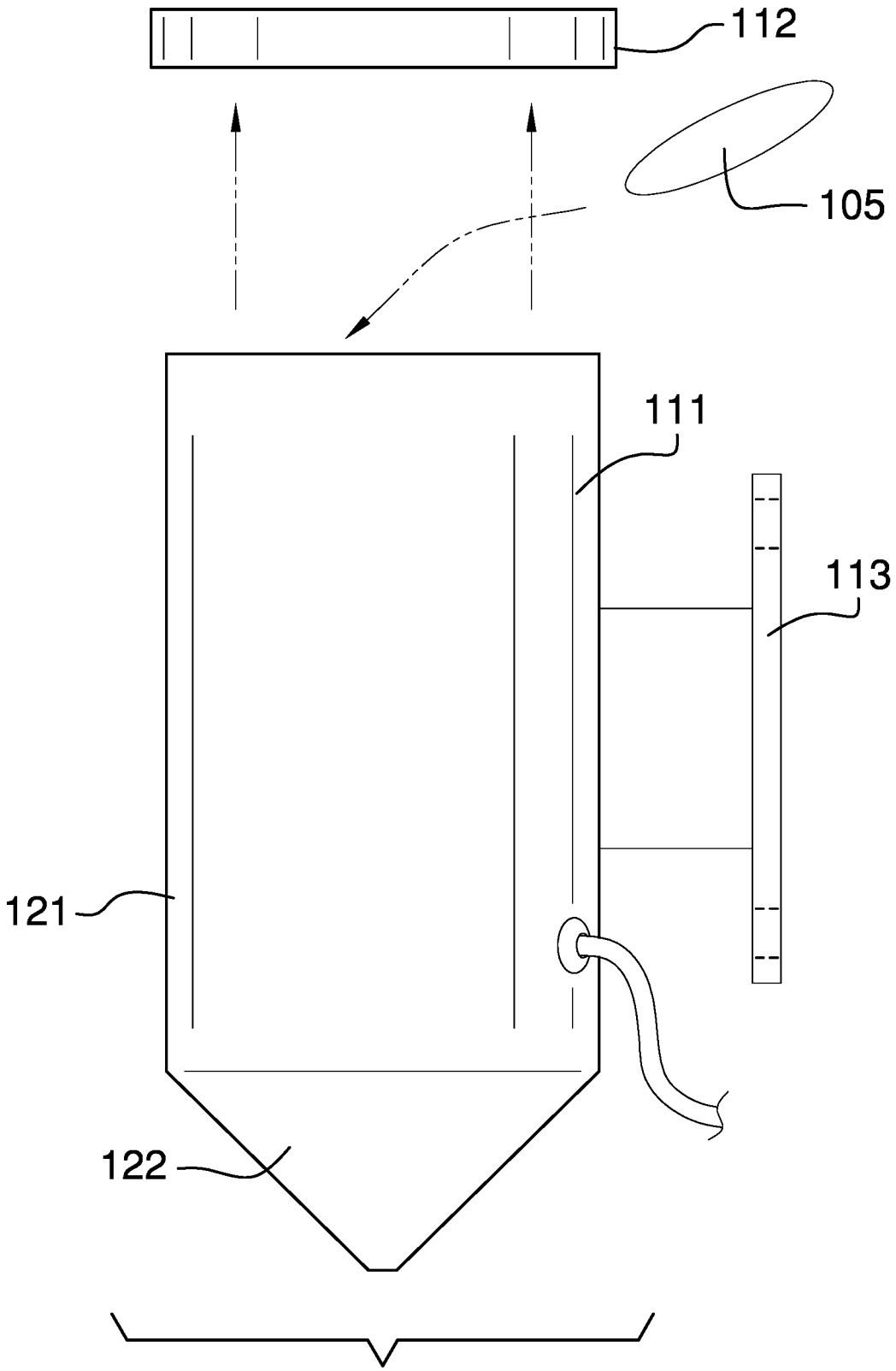
FIG. 3 is a side view of an embodiment of the disclosure.
Figure 4:
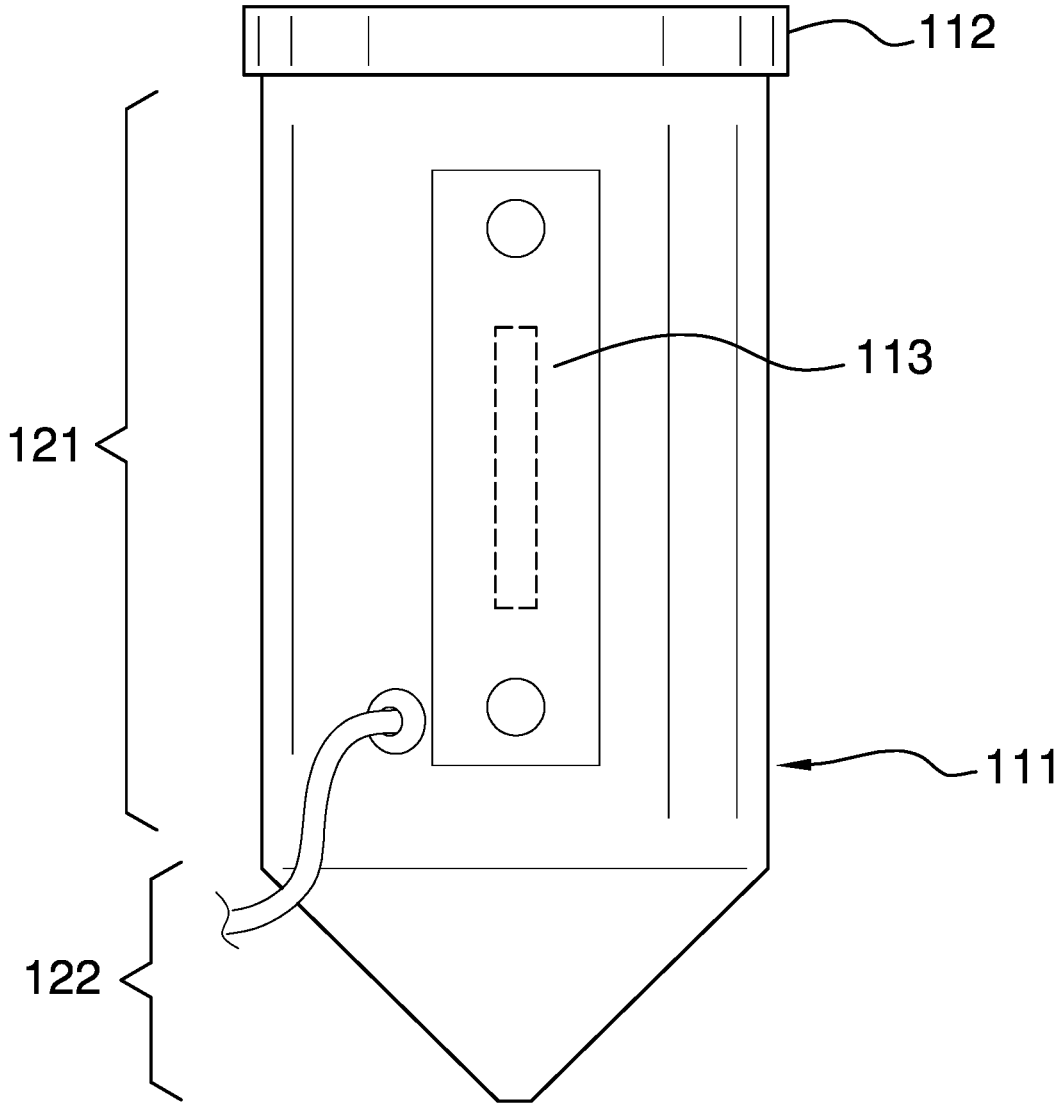
FIG. 4 is a rear view of an embodiment of the disclosure.

Detailed reference will now be made to one or more potential embodiments of the disclosure, which are illustrated in FIGS. 1 through 4.

The soap grinder and dispenser 100 (hereinafter invention) is configured for use with a plurality of soap chips 105. The invention 100 grinds the soap into a bulk solid phase. The invention 100 dispenses the plurality of soap chips 105 in a phase selected from the group consisting of: a) a liquid phase; and, b) a bulk solid phase. The invention 100 comprises a containment structure 101, a burr grinder 102, an electric motor 103, and a heating element 104. The burr grinder 102, the electric motor 103, and the heating element 104 mount in the containment structure 101. The containment structure 101 stores the plurality of soap chips 105 as a bulk solid.

The plurality of soap chips 105 forms the feed stock that is ground by the burr grinder 102. The plurality of soap chips 105 is formed from a soap. The soap is defined elsewhere in this disclosure.

The burr grinder 102 is a mechanical structure. The burr grinder 102 is a rotating structure. The burr grinder 102 grinds the plurality of soap chips 105 into a bulk solid format. The rotation of the burr grinder 102 provides the forces necessary to grind the plurality of soap chips 105 into the bulk solid phase. The rotation of the burr grinder 102 provides the motive forces necessary to move the bulk solid phase of the plurality of soap chips 105 through the containment structure 101.

The electric motor 103 is an electrical device. The electric motor 103 converts electric energy into rotational energy. The electric motor 103 mechanically attaches to the burr grinder 102. The rotation of the electric motor 103 rotates the burr grinder 102. The rotation of the electric motor 103 provides the forces necessary to grind the plurality of soap chips 105 into the bulk solid phase. The rotation of the electric motor 103 provides the rotational forces necessary allow the burr grinder 102 to move the bulk solid phase of the plurality of soap chips 105 through the containment structure 101.

The heating element 104 is an electrical device. The heating element 104 converts electric energy into heat. The heating element 104 warms the bulk solid phase of the plurality of soap chips 105 as the bulk solid phase of the plurality of soap chips 105 flows through the containment structure 101. The heating element 104 transfers to the plurality of soap chips 105 the heat necessary to melt the bulk solid phase of the plurality of soap chips 105 into a liquid phase.

The containment structure 101 is a rigid structure. The containment structure 101 is a hollow structure. The containment structure 101 is a tubular structure. The containment structure 101 has a composite prism. The containment structure 101 forms a housing that contains the burr grinder 102, the electric motor 103, and the heating element 104. The containment structure 101 is formed with the form factors and the apertures necessary to accommodate the operation of the invention 100. The containment structure 101 forms a fluid transport structure that guides the flow of the plurality of soap chips 105 through the containment structure 101 during the processing of the plurality of soap chips 105. The containment structure 101 comprises a tube structure 111, a lid structure 112, and a mounting bracket 113.

The tube structure 111 is a composite prism shape. The tube structure 111 is a hollow structure. The tube structure 111 is a rigid structure. The tube structure 111 has a tubular shape. The tube structure 111 forms the containment space of the containment structure 101. The tube structure 111 forms the boundary of the flow channel formed by the containment structure 101. The plurality of soap chips 105 are introduced into the containment structure 101 through the tube structure 111. The tube structure 111 comprises a prismatic structure 121 and a pyramid structure 122.

The prismatic structure 121 is a prism shaped structure. The prismatic structure 121 is a rigid structure. The prismatic structure 121 is a hollow structure. The prismatic structure 121 is formed as a tube. The prismatic structure 121 forms a portion of the composite prism shape of the tube structure 111. The prismatic structure 121 forms a portion of the storage space formed by the containment structure 101. The prismatic structure 121 further comprises a feed port 131.

The feed port 131 is an open end of the tubular shape of the prismatic structure 121. The feed port 131 is the open end of the prismatic structure 121 that is distal from the pyramid structure 122. The feed port 131 forms the port that receives the plurality of soap chips 105 into the tube structure 111.

The pyramid structure 122 is a pyramidal structure. The pyramid structure 122 is a rigid structure. The pyramid structure 122 is a hollow structure. The pyramid structure 122 is formed as a tube. The pyramid structure 122 forms a portion of the composite prism shape of the tube structure 111. The pyramid structure 122 forms a portion of the storage space formed by the containment structure 101. The pyramid structure 122 is formed as a truncated pyramid. The pyramid structure 122 forms a portion of the composite prism shape of the tube structure 111. The pyramid structure 122 forms a portion of the storage space formed by the containment structure 101. The open base of the pyramid structure 122 permanently attaches to the prismatic structure 121 to form the composite prism shape of the tube structure 111. The plurality of soap chips 105 flows through the tube structure 111 in the direction from the prismatic structure 121 into the pyramid structure 122. The plurality of soap chips 105 are discharged from the pyramid structure 122. The pyramid structure 122 further comprises a discharge port 132.

The discharge port 132 is an open end of the tubular shape of the prismatic structure 121. The discharge port 132 is formed at the truncated apex of the truncated pyramidal shape of the pyramid structure 122. The discharge port 132 forms the port through which the bulk solid phase of the prismatic structure 121 is discharged. The heating element 104 mounts within the pyramid structure 122 at the discharge port 132 such that the discharge port 132 further forms the port through which the phase of the plurality of soap chips 105 is discharged.

The lid structure 112 is a prism shaped structure. The lid structure 112 has a disk shaped structure. The lid structure 112 has a pan shape. The lid structure 112 is sized such that the tube structure 111 of the containment structure 101 inserts into the lid structure 112. The lid structure 112 encloses the feed port 131 of the prismatic structure 121 of the tube structure 111.

The mounting bracket 113 is a mechanical structure. The mounting bracket 113 attaches to the lateral face of the composite prism shape of the tube structure 111. The mounting bracket 113 permanently secures the invention 100 to a vertically oriented surface.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bracket: As used in this disclosure, a bracket is a mechanical structure that attaches a second structure to a first structure such that the load path of the second structure is fully transferred to the first structure.

Bulk Solid: As used in this disclosure, a bulk solid is a material that is formed from an accumulation of discrete particles. While the discrete particles of the bulk solid are solid materials, in aggregate the physical performance of bulk solid will exhibit fluid characteristics such as flow or taking the shape of a container.

Burr Grinder: As used in this disclosure, a burr grinder is a type of grinder. The burr grinder grinds material between two abrasive surfaces, one of which rotates relative to the others. The burr grinder is known for grinding material into particles of a consistent size. The burr grinder is also known as a burr mill.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid.

When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Exterior: As used in this disclosure, the exterior is used as a relational term that implies that an object is not contained within the boundary of a structure or a space.

Fatty Acid: As used in this disclosure, a fatty acid refers to a carboxylic acid with a continuous carbon chain of greater than 3 carbon atoms beyond the carboxyl functional group. Form Factor: As used in this disclosure, the term form factor refers to the size and shape of an object.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grinder: As used in this disclosure, a grinder is a machine that reduces a material into small particles.

Heating Element: As used in this disclosure, a heating element is a resistive wire that is used to convert electrical energy into heat. Common metal combinations used to form heat elements include a combination of nickel and Chromium (typical: 80/20), a combination of iron, chromium, and aluminum (typical 70/25/5), a combination of copper, nickel, iron, and manganese (typical 66/30/2/2) (use for continuously hot), and platinum.

Housing: As used in this disclosure, a housing is a rigid structure that encloses and protects one or more devices.

Interior: As used in this disclosure, the interior is used as a relational term that implies that an object is contained within the boundary of a structure or a space.

Lid: As used in this disclosure, a lid is a removable cover that is placed over an opening of a hollow structure to enclose the hollow structure.

Liquid: As used in this disclosure, a liquid refers to a state (phase) of matter that is fluid and that maintains, for a given pressure, a fixed volume that is independent of the volume of the container.

Motor: As used in this disclosure, a motor refers to the method of transferring energy from an external power source into rotational mechanical energy.

Mount: As used in this disclosure, a mount is a mechanical structure that attaches or incorporates a first object to a second object.

N-gon: As used in this disclosure, an N-gon is a regular polygon with N sides wherein N is a positive integer number greater than 2.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Phase Change Terminology: As used in this disclosure, the following terms are used to describe a phase change. A phase change from a solid phase to a liquid phase is called melting. A phase change from a liquid phase to a solid phase is called freezing or solidification. A phase change from a solid phase to a gas phase is called sublimation. A phase change from a gas phase to a solid phase is called deposition. A phase change from a liquid phase to a gas phase is called evaporation. A phase change from a gas phase to a liquid phase is called condensation. A phase change from a gas phase to a plasma phase is called ionization. A phase change from a plasma phase to a gas phase is called recombination.

Plasma: As used in this disclosure, plasma refers to a state (phase) of matter wherein the outer valence electrons of an atom (or molecule) have been separated from their nucleus but remain with the matter. A plasma is an electrically neutral state of matter that is formed from the ions of the separated atoms. Plasmas generally, but not necessarily behaves like a gas in that a plasma fills the volume of the structure that contains it. The flow of a plasma through the atmosphere is called an arc. An arc is generally created when the atmosphere is subjected to an electric field that ionizes the molecules forming the atmosphere.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Salt: As used in this disclosure, a salt means an ionic compound that further comprises at least one atom of a metallic element or compound and one atom of a non-metallic element or compound. When dissolved in water, the ionic compound releases the metallic element and the non-metallic element into the water as ions. In this disclosure, a metallic element is assumed to include the alkali metals and the alkali earth metals. Alternatively, and equivalently, a metallic element may be assumed to be any element on the periodic table that is to the left of the metalloids. The term salt refers often refers to the chemical compound sodium chloride (CAS 7647-14-5). The chemical formula of sodium chloride is NaCl. Sodium chloride forms with an ionic bond.

Soap: As used in this disclosure, a soap is a cleansing chemical that is used in cleaning an object. A soap is generally formed from a mixture of one or more salts and one or more fatty acids.

Solid: As used in this disclosure, a solid refers to a state (phase) of matter that: 1) has a fixed volume; and, 2) does not flow.

Truncated: As used in this disclosure, a geometric object is truncated when an apex, vertex, or end is cut off by a line or plane.

Truncated Pyramid: As used in this disclosure, a truncated pyramid is a frustum that remains when the apex of a pyramid is truncated by a plane that is parallel to the base of the pyramid.

Tube: As used in this disclosure, a tube is a hollow cylindrical device that is used for transporting liquids and gases. The line that connects the center of the first base of the cylinder to the center of the second base of the cylinder is referred to as the center axis of the tube or the centerline of the tube. In this disclosure, the terms inner diameter of a tube and outer diameter of a tube are used as they would be used by those skilled in the plumbing arts.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A soap grinder and dispenser comprising a containment structure, a burr grinder, an electric motor, and a heating element;

wherein the burr grinder, the electric motor, and the heating element mount in the containment structure;

wherein the soap grinder and dispenser is configured for use with a plurality of soap chips;

wherein the soap grinder and dispenser dispenses the plurality of soap chips in a phase selected from the group consisting of: a) a liquid phase; and, b) a bulk solid phase;

wherein the heating element is an electrical device that converts electric energy into heat;

wherein the heating element warms the bulk solid phase of the plurality of soap chips as the bulk solid phase of the plurality of soap chips flows through the containment structure;

wherein the heating element transfers to the plurality of soap chips the heat necessary to melt the bulk solid phase of the plurality of soap chips into the liquid phase.

2. The soap grinder and dispenser according to claim 1 wherein the soap grinder and dispenser grinds the soap into the bulk solid phase;

wherein the containment structure stores the plurality of soap chips as the bulk solid phase.

3. The soap grinder and dispenser according to claim 2 wherein the burr grinder is a mechanical structure;

wherein the burr grinder is a rotating structure;

wherein the burr grinder grinds the plurality of soap chips into the bulk solid phase;

wherein a rotation of the burr grinder provides forces necessary to grind the plurality of soap chips into the bulk solid phase;

wherein the rotation of the burr grinder provides motive forces necessary to move the bulk solid phase of the plurality of soap chips through the containment structure.

4. The soap grinder and dispenser according to claim 3 wherein the electric motor is an electrical device;

wherein the electric motor converts electric energy into rotational energy;

wherein the electric motor mechanically attaches to the burr grinder;

wherein rotation of the electric motor rotates the burr grinder;

wherein the rotation of the electric motor provides the forces necessary to grind the plurality of soap chips into the bulk solid phase;

wherein the rotation of the electric motor provides the motive forces necessary to allow the burr grinder to move the bulk solid phase of the plurality of soap chips through the containment structure.

5. The soap grinder and dispenser according to claim 4 wherein the containment structure is a rigid structure;

wherein the containment structure is a hollow structure;

wherein the containment structure has a composite shape.

6. The soap grinder and dispenser according to claim 5 wherein the containment structure forms a housing that contains the burr grinder, the electric motor, and the heating element;

wherein the containment structure forms a fluid transport structure that guides the flow of the plurality of soap chips through the containment structure during the grinding and/or the melting of the plurality of soap chips.

7. The soap grinder and dispenser according to claim 6 wherein the containment structure comprises a tube structure, a lid structure, and a mounting bracket;

wherein the lid structure attaches to the tube structure;

wherein the mounting bracket attaches to the tube structure.

8. The soap grinder and dispenser according to claim 7 wherein the tube structure has a composite shape;

wherein the tube structure is a hollow structure;

wherein the tube structure is a rigid structure;

wherein the tube structure forms the containment space of the containment structure;

wherein the tube structure forms the boundary of a flow channel formed by the containment structure.

9. The soap grinder and dispenser according to claim 8 wherein the tube structure comprises a prismatic structure and a pyramid structure;

wherein the pyramid structure attaches to the prismatic structure.

10. The soap grinder and dispenser according to claim 9 wherein the prismatic structure is a rigid structure;

wherein the prismatic structure is a hollow structure;

wherein the prismatic structure is formed as a tube;

wherein the prismatic structure forms a portion of the composite shape of the tube structure;

wherein the prismatic structure forms a portion of a storage space formed by the containment structure.

11. The soap grinder and dispenser according to claim 10 wherein the pyramid structure is a rigid structure;

wherein the pyramid structure is a hollow structure;

wherein the pyramid structure is formed as a tube;

wherein the pyramid structure forms a portion of the composite shape of the tube structure;

wherein the pyramid structure forms another portion of the storage space formed by the containment structure;

wherein the pyramid structure is formed as a truncated pyramid;

wherein an open base of the pyramid structure permanently attaches to the prismatic structure to form the composite shape of the tube structure;

wherein the plurality of soap chips flows through the tube structure in a direction from the prismatic structure into the pyramid structure;

wherein the plurality of soap chips are discharged from the pyramid structure.

12. The soap grinder and dispenser according to claim 11 wherein the prismatic structure further comprises a feed port;

wherein the feed port is an open end of the prismatic structure;

wherein the open end is distal from the pyramid structure;

wherein the feed port forms the port that receives the plurality of soap chips into the tube structure.

13. The soap grinder and dispenser according to claim 12 wherein the pyramid structure further comprises a discharge port;

wherein the discharge port is another open end of the prismatic structure;

wherein the discharge port is formed at a truncated apex of the pyramid structure;

wherein the bulk solid phase or liquid phase is discharged through the discharge port;

wherein the heating element mounts within the pyramid structure at the discharge port.

14. The soap grinder and dispenser according to claim 13 wherein the lid structure has a disk shaped structure;

wherein the lid structure has a pan shape;

wherein the lid structure is sized such that the tube structure of the containment structure inserts into the lid structure;

wherein the lid structure encloses the feed port of the prismatic structure of the tube structure;

wherein the mounting bracket is a mechanical structure;

wherein the mounting bracket attaches to a lateral face of the composite shape of the tube structure;

wherein the mounting bracket permanently secures the soap grinder and dispenser to a vertically oriented surface.

* * * * *